US008282583B2

(12) United States Patent
Tsai

(10) Patent No.: US 8,282,583 B2
(45) **Date of Patent: *Oct. 9, 2012**

(54) MASSAGE DEVICE WITH DUAL MASSAGE UNITS

(76) Inventor: Ming-Wei Tsai, Taipei Hsien (TW)

( * ) Notice: Subject to any disclaimer, the term of this patent is extended or adjusted under 35 U.S.C. 154(b) by 945 days.

This patent is subject to a terminal disclaimer.

(21) Appl. No.: 12/351,626

(22) Filed: Jan. 9, 2009

(65) Prior Publication Data

US 2010/0179460 A1 Jul. 15, 2010

(51) Int. Cl.
*A61H 7/00* (2006.01)
*A61H 19/00* (2006.01)

(52) U.S. Cl. ..... 601/84; 601/101; 601/103; 601/104; 601/112; 601/116

(58) Field of Classification Search ..... 601/84, 601/97–104, 112–116, 128, 131, 134; D24/211, D24/212, 213; 475/329, 331, 332, 346
See application file for complete search history.

(56) References Cited

U.S. PATENT DOCUMENTS

| | | | | |
|---|---|---|---|---|
| 1,577,751 | A * | 3/1926 | Paschall | 601/112 |
| 4,944,195 | A * | 7/1990 | Takahashi et al. | 74/409 |
| 5,105,802 | A * | 4/1992 | Pokorny | 601/131 |
| 5,382,221 | A * | 1/1995 | Hsu et al. | 601/114 |
| 5,573,500 | A * | 11/1996 | Katsunuma et al. | 601/111 |
| 5,725,483 | A * | 3/1998 | Podolsky | 601/15 |
| 7,270,641 | B2 * | 9/2007 | Glucksman et al. | 601/112 |
| 7,276,034 | B1 * | 10/2007 | Elnar | 601/55 |
| 8,062,240 | B2 * | 11/2011 | Chiang | 601/98 |
| 8,070,698 | B2 * | 12/2011 | Wu et al. | 601/87 |
| 2005/0209538 | A1 * | 9/2005 | Lev et al. | 601/15 |
| 2010/0042025 | A1 * | 2/2010 | Wu | 601/134 |

FOREIGN PATENT DOCUMENTS

JP 01195867 A * 8/1989

* cited by examiner

*Primary Examiner* — Justine Yu
*Assistant Examiner* — Raymond G Chen
(74) *Attorney, Agent, or Firm* — Birch, Stewart, Kolasch & Birch, LLP

(57) ABSTRACT

A massage device includes a housing, a driving unit and two massage units driven by the driving unit. Each massage unit includes a planetary gear disc assembled with a universal joint, an inner gear engaged with the planetary gear disc, and a massage disc assembly disposed on a top of the inner gear and driven by the universal joint. The driving unit drives the planet gear disc to rotate and the universal joint drives the massage disc assembly to rotate, thereby providing kneading massage. The inner gear has an incline top surface. When the planet gear disc drives the inner gear to rotate, the incline top surface makes the massage balls on the massage disc assembly to move up and down, thereby providing patting massage. Thus, the massage device can produce kneading and patting massage actions.

7 Claims, 8 Drawing Sheets

MASSAGE DEVICE WITH DUAL MASSAGE UNITS

BACKGROUND OF THE INVENTION

1. Field of the Invention

The present invention generally relates to a massage device, and more particularly to a massage device adapted to apply massage and heating.

2. The Prior Arts

A conventional stationary massage device, such as a foot, lower back, shoulder or neck massage device, usually includes a housing in which is assembled a driving unit adapted to drive multiple massage balls to rotate. When the massage balls is put in contact with the human body, the rotating massage balls provides a massage action on a region of the human body subjected to massage. The driving unit usually includes a motor coupled with a worm shaft. The worm shaft engages with several intermediary gears that in turn drive a follower wheel coupled with the massage balls in rotation.

The massage device is usually capable of applying only a single kneading massage action on a single part of a human body. Further, the massage action is usually superficial, cannot penetrate deep muscle tissue, and fails to adequately enhance blood circulation.

SUMMARY OF THE INVENTION

A primary objective of the present application is to provide a massage device that can apply multiple massage actions and can apply deep tissue massage to enhance blood circulation and offer a great relief for fatigue.

To achieve the objective, a massage device according to an embodiment of the present invention comprises a housing in which is placed a driving unit casing having a driving unit therein. An outer surface of the driving unit casing is coupled with two massage units driven in movement by the driving unit. The driving unit includes a series of gears. Each of the massage units includes a planetary gear disc that is assembled with a universal joint, an inner gear engaged with the planetary gear disc, and a massage disc assembly connected with the inner gear and driven by the universal joint. A plurality of massage balls are mounted in the massage disc assembly. The massage unit mounted on the driving unit casing connects with a rotary axle of the driving unit. The planetary gear disc is driven by the rotary axle, and consequently causes the massage disc assembly to rotate. The planetary gear disc also drives the inner gear to rotate, such that the massage balls on the rotating massage disc assembly performs up and down oscillating movements. Therefore, the massage device is thus able to provide kneading and patting massage actions.

With the above construction, the motor drives a synchronized rotation of the two massage units, and the interaction between the planetary gear disc and the inclined surface of the inner gear enables to rotate the rotary axle for driving the planetary gear disc and inner gear in rotation, thereby causing rotation and up and down oscillation movements of the massage disc assembly. As a result, at least two different types of massage actions can be performed with minimum structural components. Moreover, heating elements may be provided within the massage disc assembly for applying heating during massage, which thereby promotes blood circulation and relieves fatigue in an effective manner.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

Figure 1:
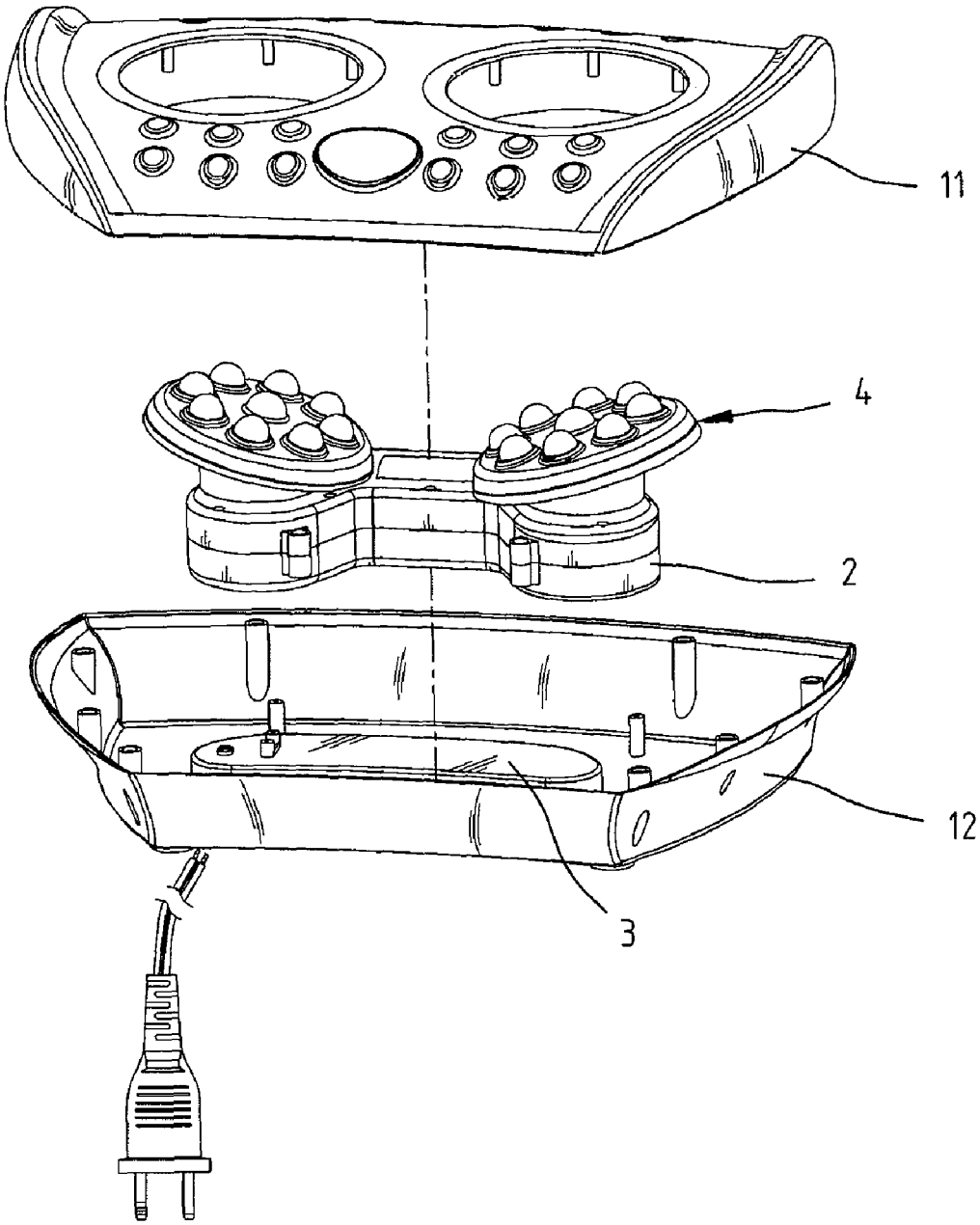
FIG. 1 is an exploded view showing a massage device with dual massage units according to an embodiment of the present invention.

Referring to FIGS. 1, 2, 2A and 3, a massage device with dual massage units according to an embodiment of the present invention includes a housing 1, a driving unit casing 2, an electric controller 3, two massage units 4 and a driving unit 5. The driving unit 5 is received in the driving unit casing 2. The driving unit casing 2, the electric controller 3 and the massage units 4 are received in the housing 1.

Figure 2:
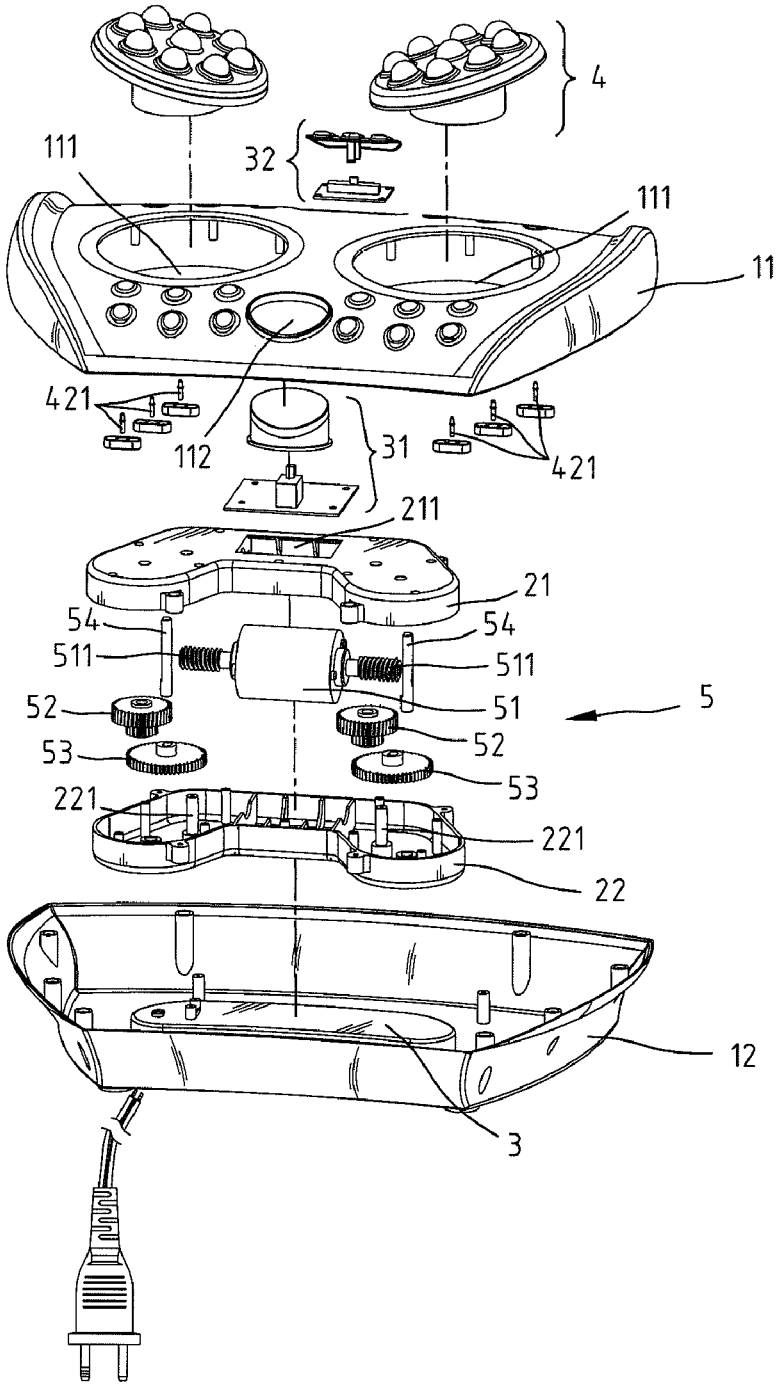
FIG. 2 is another exploded view showing the massage device according to the present invention.
Figure 2A:
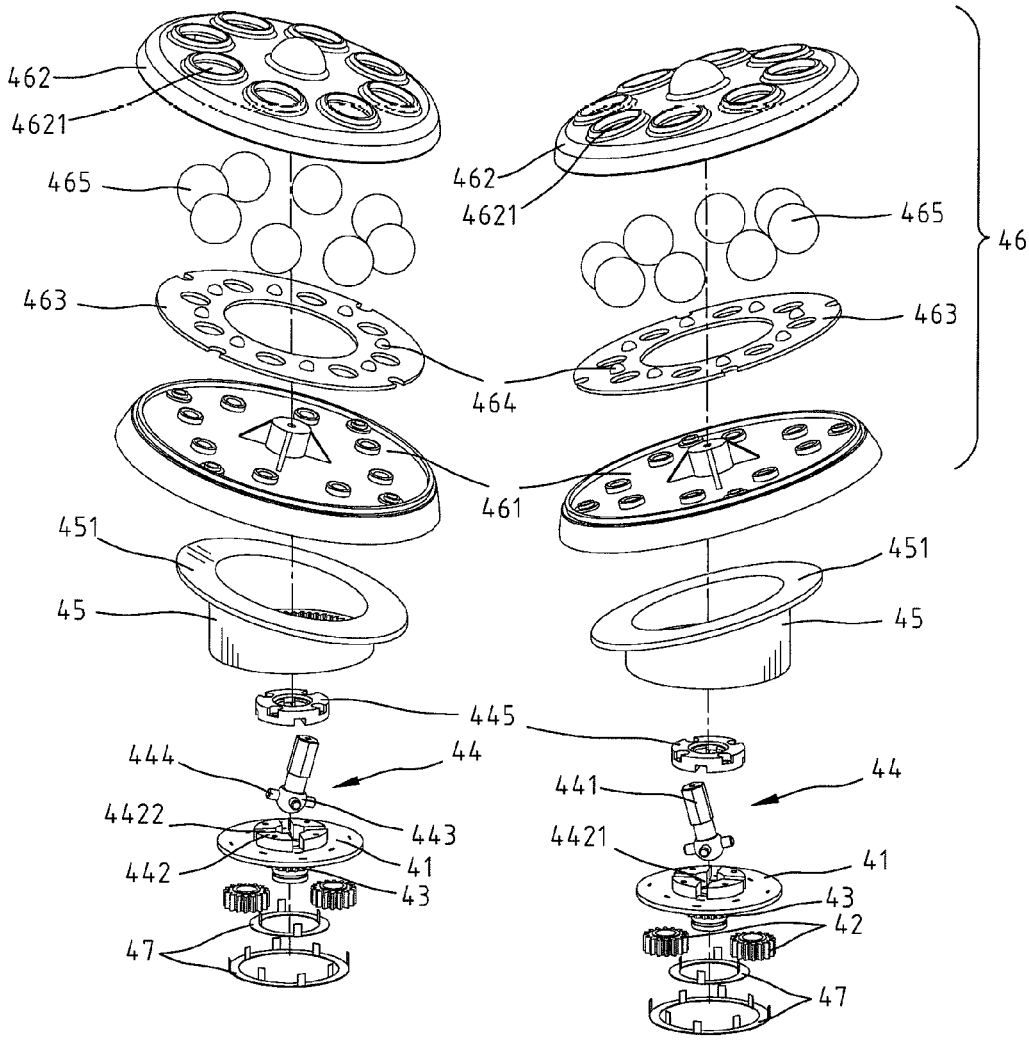
FIG. 2A is a partially enlarged view of FIG. 2 to show massage units.
Figure 3:
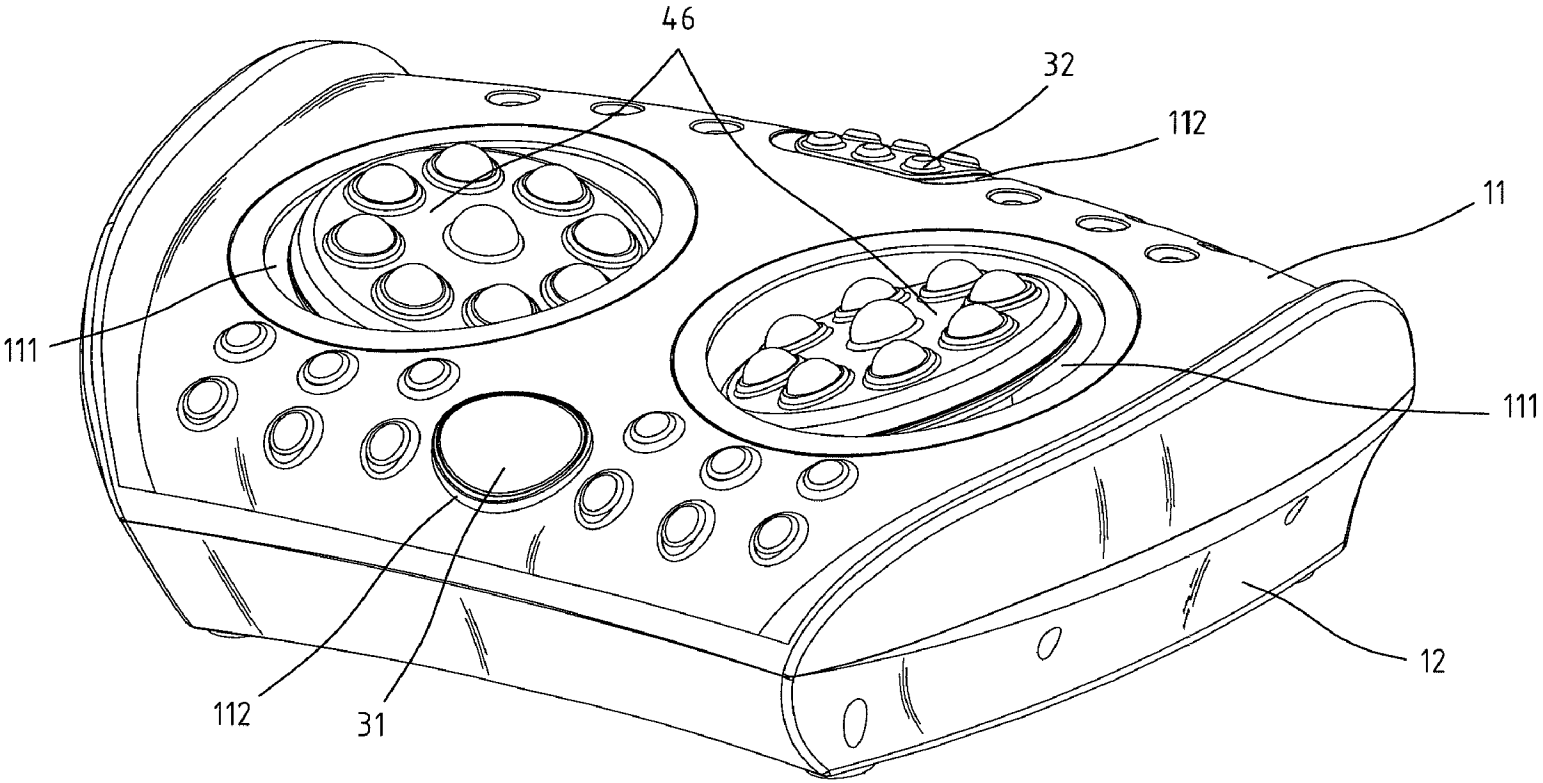
FIG. 3 is a perspective view showing the massage device according to the embodiment of the present invention.

Referring to FIGS. 2, 2A and 3, the housing 1 comprises an upper housing cover 11 and a lower housing cover 12. An inner housing space is defined between the upper housing cover 11 and the lower housing cover 12. The housing 1 has an ergonomic shape having an inclined angle as shown in FIG. 3. The upper housing cover 11 includes two openings 111 through which each of the massage units 4 protrudes outward, and two button holes 112 for placement of a power switch 31 and a speed setting switch 32. The driving unit casing 2 includes an upper casing 21 and a lower casing 22 that define a hollow space therebetween. The upper casing 21 includes a casing opening 211. The power switch 31 and the speed setting switch 32 are electrically connected with the electric controller 3. The lower casing 22 includes a plurality of posts 221 and the driving unit 5 is mounted on the posts 221. The hollow space between the upper casing 21 and the lower casing 22 is adapted to receive the driving unit 5. The driving unit 5 includes a motor 51 that has two axles and each of the axles is respectively coupled with a worm shaft 511. Each worm shaft 511 engages with a double gear 52 that is in engagement with a spur gear 53. A rotary axle 54 is fitted into a center of the spur gear 53. Each of the massage units 4 includes a planetary gear disc 41. The rotary axle 54 passes through a through hole of the upper casing 21 and is coupled to a center of the planetary gear disc 41. A bottom surface of the planetary gear disc 41 is coupled with an active gear 43 that is in engagement with three planet gears 42 (FIG. 2A shows only two of the planet gears 42 and the third one is behind the active gear 43). Each of the planet gears 42 is coupled with a planet gear shaft 421 that is fixed on a top of the upper casing 21. A universal joint 44 is movably mounted on a top of the planetary gear disc 41. The planetary gear disc 41 is received in an inner gear 45 that is in engagement with the three planetary gears 42. The inner gear 45 has an inclined surface 451 that slidably coupled with a massage disc assembly 46. The universal joint 44 connects with the massage disc assembly 46. The massage disc assembly 46 comprises a cap-like bottom disc 461 connected with a universal joint axle 441 by a screw, an top cover 462 provided with a plurality of restricting openings 4621, a circuit board 463 mounted on the bottom disc 461, a plurality of lamps 464 disposed on the circuit board 463, and a plurality of massage members 465. The bottom disc 461 includes a cap-like bottom. The inner gear 45 is received in the bottom of the bottom disc 461 and the inclined surface 451 is slidably pressed against the bottom of the bottom disc 461. The bottom disc 461 has a receiving portion at a center thereof to receive the universal joint axle 441 of the universal joint 44 and a plurality of ribs extended from the receiving portion to reinforce the structural strength of the bottom disc 461. The massage members 465 are disposed between the top cover 462 and circuit board 463 and confined within the restricting openings 4621. The massage members 465 may be made of plastics, metal, glass, resin, ceramics, etc. The massage device according to the present invention may combine with alternative medicine and the massage members 465 may be made of magnetite, Germanium, Titanium, or a material containing the aforementioned ingredients to alleviate muscle pain and enhance blood circulation.

To provide smooth movement of the universal joint 44, a joint base 442 is provided on the top of the planetary gear disc 41. The joint base 442 includes a socket portion 4421 disposed at a center thereof for receiving a ball 443 of the universal joint 44 and four recesses 4422 extended radially from the socket portion 4421 for receiving support ribs 444 of the universal joint 44. A joint cover 445 is assembled on the joint base 442. A central region of the joint cover 445 has a through hole that allows the universal joint axle 441 of the universal joint 44 to pass through. The movement of the universal joint 44 is thereby restricted by the joint base 442 and the joint cover 445. To provide heating of each massage disc assembly 46, a bottom side of the planetary gear disc 41 is coupled with a large and small sliding rings made of copper. The large and small sliding rings 47, a circuit board 463 and lamps 464 are electrically connected. The massage unit 4 is assembled on the driving unit casing 2 according to the method mentioned above. The driving unit casing 2 is secured on the lower housing cover 12. After the upper housing cover 11 is assembled with the lower housing cover 12, the two massage units 4 are restricted within the two openings 111 of the upper housing cover 11, whereas the power switch 31 and the speed setting switch 32 on the driving unit casing are also restricted within the corresponding button holes 112 of the upper housing cover 11. The assembly of the massage device 4 as shown in FIG. 3 is thereby completed.

Figure 4:
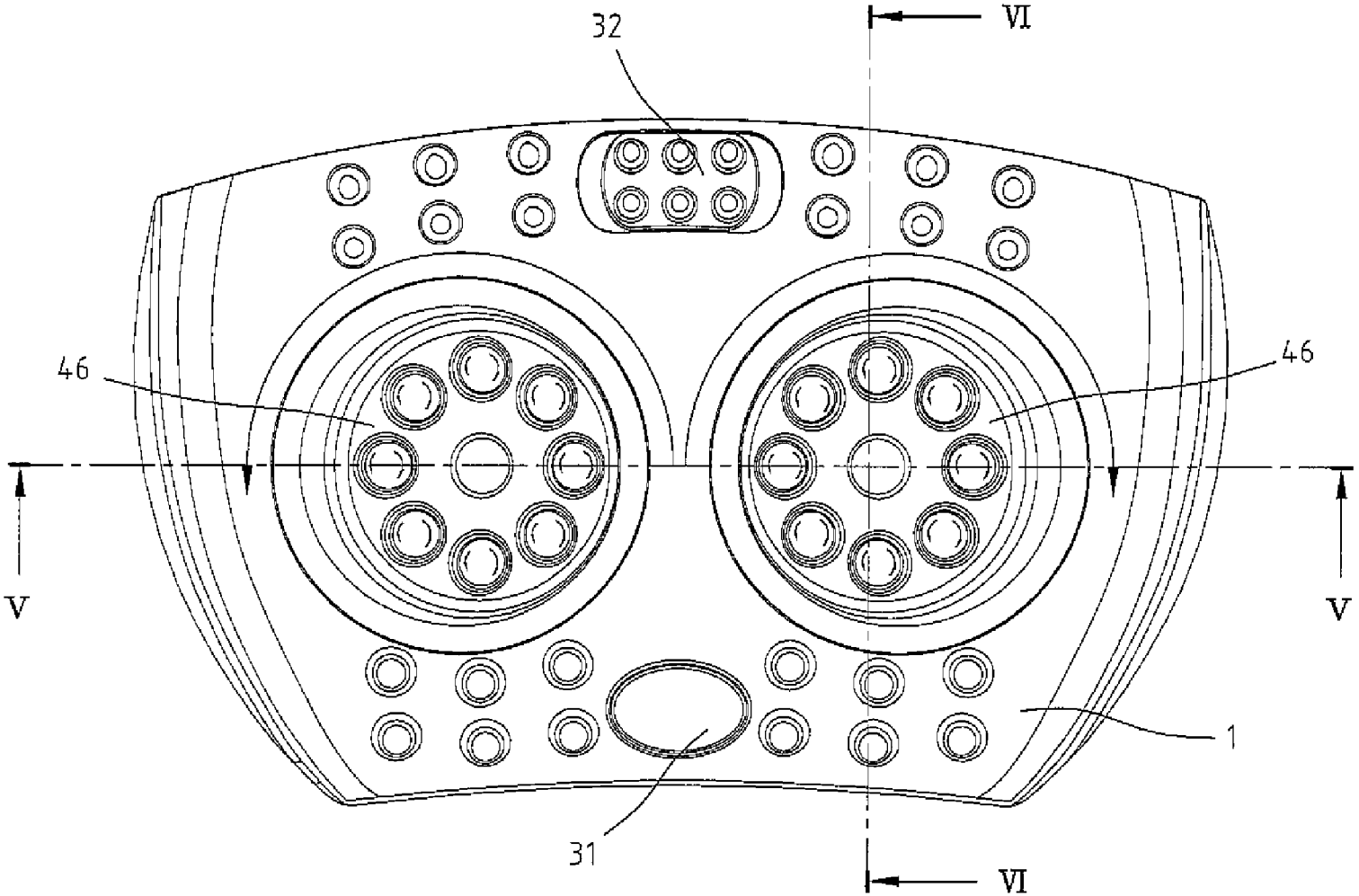
FIG. 4 is a top view showing the massage device according to the embodiment of the present invention.
Figure 5:
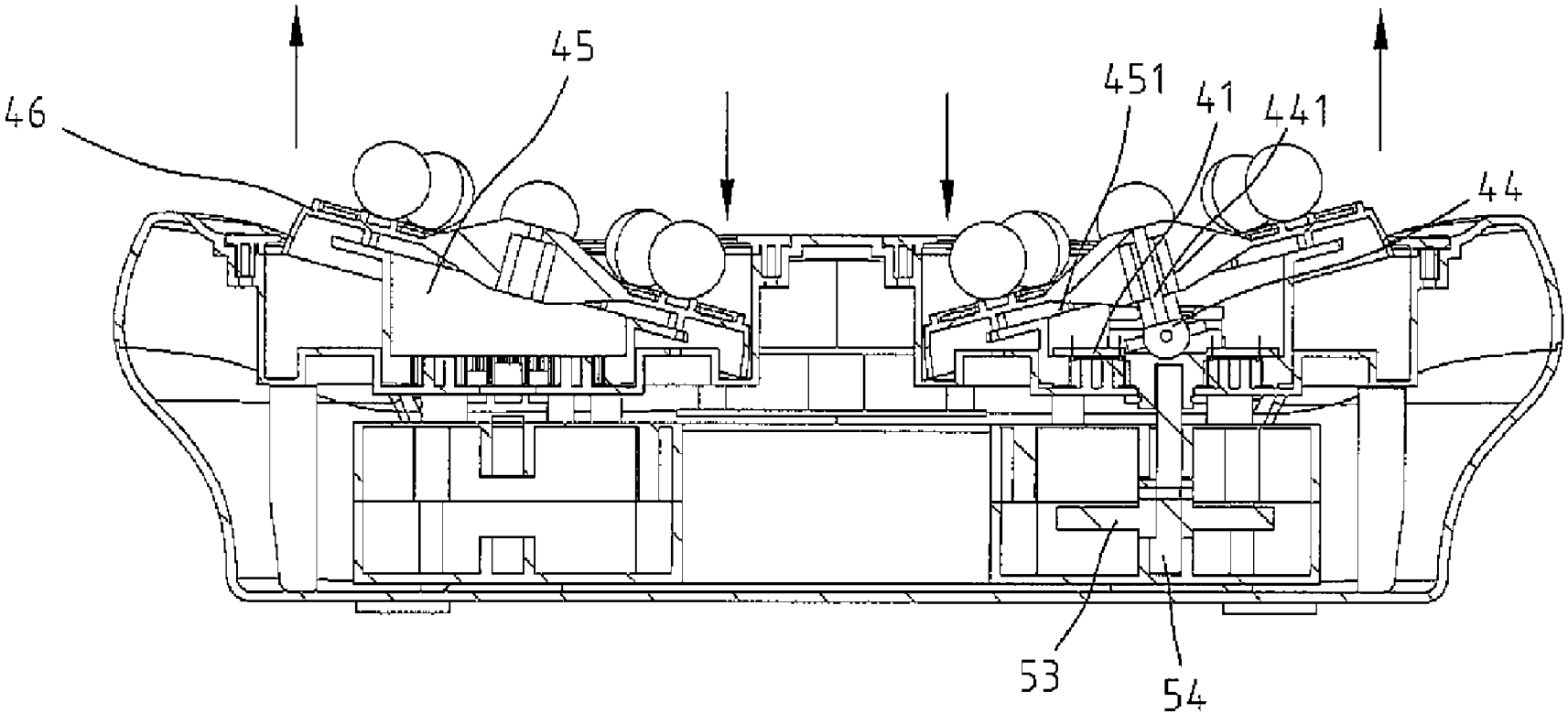
FIG. 5 is a cross-sectional view taken along line V-V in FIG. 4 showing the massage device.
Figure 6:
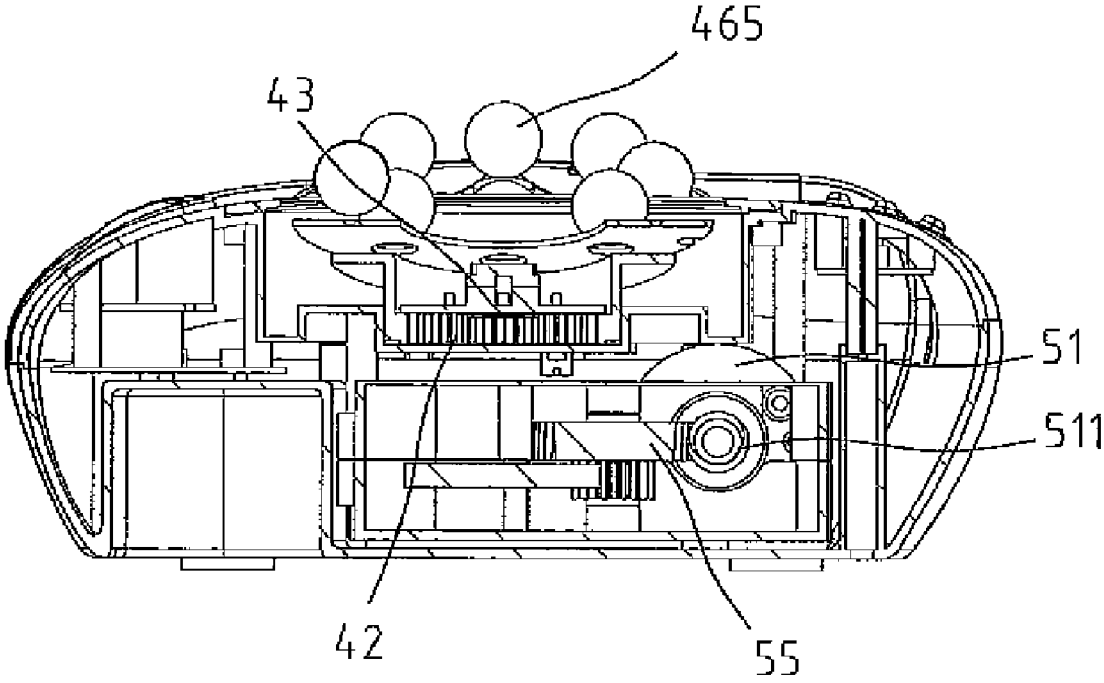
FIG. 6 is a cross-sectional view taken along line VI-VI in FIG. 4 showing the massage device.

FIGS. 4-6 are various additional views showing the massage device with dual massage units according to the embodiment of the present invention. More specifically, FIG. 4 is a top view of the massage device, FIG. 5 is a cross-sectional view taken along section line V-V shown in FIG. 4, and FIG. 6 is a cross-sectional view taken along section line VI-VI shown in FIG. 4. Once the power switch 31 is pushed to start the motor 51, the two axles of the motor 51 drive the two worm shafts 511 to rotate, respectively. The worm shaft 511 drives the double gear 52 and the double gear 52 drives the spur gear 53. Because the spur gear 53 is securely connected with the rotary axle 54 and the rotary axle 54 is coupled with the planetary gear disc 41, the planetary gear disc 41 is driven to rotate. The ball 443 and the support ribs 444 of the universal joint 44 are received in the joint base 442 of the planet gear disc 41, and the bottom disc 461 of the massage disc assembly 46 is connected with the universal joint axle 441 of the universal joint 44. Therefore, the massage disc assembly 46 rotates along with the planetary gear disc 41. Because the massage members 465 are restricted in the restricting openings 4621 of the top cover 462, the rotating massage disc assembly 46 will force the massage member 465 to spin. Because the massage disc assembly 46 is disposed on the inclined surface 451 of the inner gear 45, the rotating massage disc assembly 46 slides on the inclined surface 451. The rotating massage disc assembly 46 and the spinning massage members provide kneading massage. The active gear 43 of the planetary gear disc 41 then drives the three planet gears 42 in rotation. As a result, the planet gears 42 drive the inner gear 45 to rotate. Owing to the inclined surface 451 of the inner gear 45, the rotating inner gear 45 will provide the massage members 465 with up and down patting massage movement.

Figure 7:
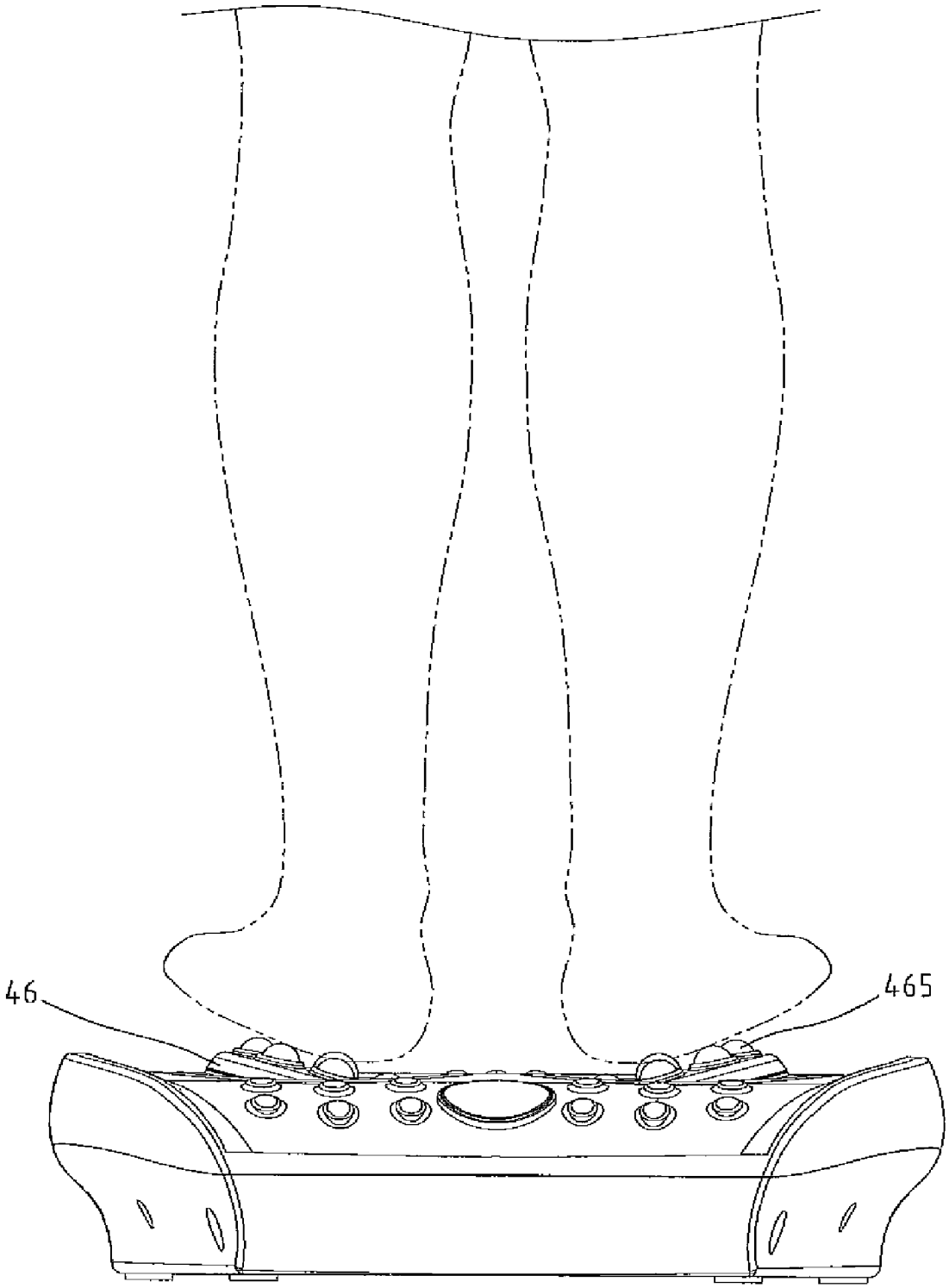
FIG. 7 is a schematic view showing the massage device used to massage a user's feet.

The massage device with dual massage units according to the present invention may be adapted to apply kneading and patting massage actions on various parts of a human body, such as feet, thighs, lower back, etc. Referring to FIG. 7, the massage device is used for foot massage. With also reference to FIG. 2, when the feet are pressed against the massage disc assemblies 46, the rotating massage disc assemblies 46 and the spinning massage members 465 provide kneading massage on bottoms of the feet. Further, as the massage members 465 of the massage disc assemblies 46 reciprocate moving up and down, an intermittent pressing action is also applied on the feet. In the meantime, the large and small sliding rings 47 also supply power to the lamps 464 on the circuit board 463. The top cover 462 of the massage disc assembly 46 may be made of a transparent or translucent material, so that the light and heat from the lamps 464 may be propagated through the top cover 462. Heating can thereby be applied on the body parts subjected to massage, whereas the illumination of the lamps 464 creates a vivid effect that improves the aesthetic appearance of the massage device. Through the electric controller 3 and the speed setting switch 32, the rotation speed of the massage disc assemblies 46, the desired massage strength and ON/OFF of the heating function may be adjusted. The power switch 31 and the speed setting switch 32 may be combined to a single switch.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A massage device with dual massage units comprising:

a housing including an upper housing cover and a lower housing cover that define an inner housing space, the upper housing cover having two openings;

a driving unit disposed in a driving unit casing, the driving unit casing received in the inner housing space;

two massage units driven by the driving unit, mounted on a top of the driving unit casing and received in the inner housing space, tops of the massage units respectively located at the openings of the housing, each of the massage units comprising a planetary gear disc, a universal joint mounted on a top of the planetary gear disc, an inner gear engaged with and driven by the planetary gear disc, and a massage disc assembly disposed on a top of the inner gear and driven by the universal joint; and an electric controller mounted in the housing and comprising a controller circuit and at least one switch;

wherein the driving unit drives the planetary gear discs to rotate, each massage disc assembly is driven to rotate by the universal joint and a plurality of massage members disposed on the top of each massage disc assembly are forced to spin, each inner gear includes an inclined surface at the top thereof, and each planetary gear disc drives the inner gear to rotate and thus the massage members reciprocate moving up and down.

2. The massage device according to claim 1, wherein the driving unit comprises a motor having two axles, each of the two axles is coupled with a worm shaft, the worm shaft is engaged with a set of gears having a rotary axle and the rotary axle is coupled with one of the planetary gear discs.

3. The massage device according to claim 1, wherein each massage disc assembly comprises a bottom disc connected with the universal joint, a top cover having a plurality of restricting openings corresponding to the massage members, a circuit board mounted on the bottom disc, a plurality of lamps disposed on the circuit board, and the massage members located between the top cover and the circuit board; each planetary gear disc is coupled with a sliding copper ring that is electrically connected with the circuit board and the lamps.

4. The massage device according to claim 1, wherein the massage members are made of one of magnetite, germanium and titanium.

5. The massage device according to claim 3, wherein the massage members are made of one of magnetite, germanium and titanium.

6. The massage device according to claim 1, wherein the massage members contain an ingredient selected from magnetite, germanium and titanium.

7. The massage device according to claim 3, wherein the massage members contain an ingredient selected from magnetite, germanium and titanium.

* * * * *